US005189385A

United States Patent [19]

Gnahn

[11] Patent Number: 5,189,385

[45] Date of Patent: Feb. 23, 1993

[54] INTERLOCK FOR ELECTROMAGNETIC SWITCHING DEVICES

[75] Inventor: Günter Gnahn, Sulzbach-Rosenberg, Fed. Rep. of Germany

[73] Assignee: Siemens Aktiengesellschaft, Berlin & Munich, Fed. Rep. of Germany

[21] Appl. No.: 686,046

[22] Filed: Apr. 16, 1991

[30] Foreign Application Priority Data

Apr. 18, 1990 [DE] Fed. Rep. of Germany ... 9004431[U]

[51] Int. Cl.[5] ..... H01H 67/02

[52] U.S. Cl. ..... 335/132; 200/50 C

[58] Field of Search ..... 200/50 CC, 50 C, 50 AA; 335/131-132, 202

[56] References Cited

U.S. PATENT DOCUMENTS 3,233,052 2/1966 Contal ..... 335/132

4,956,624 9/1990 Streich et al. .

FOREIGN PATENT DOCUMENTS 2114509 10/1972 Fed. Rep. of Germany .

3011779 10/1981 Fed. Rep. of Germany .

3213477 3/1989 Fed. Rep. of Germany .

*Primary Examiner*—Lincoln Donovan

*Attorney, Agent, or Firm*—Kenyon & Kenyon

[57] ABSTRACT

An interlock mechanically locks out of one of two electromagnetic switching devices which are located side by side while the other switching device is in its closed position. The interlock achieves this lockout by adapting the moving parts of the switching devices, which are to be coupled, to locking elements. The locking elements are preferably slide bars which extend from the interlock. The moving parts of the switching devices form coupling members for auxiliary switches. These auxiliary switches can be set onto the switching device. The slide bars conform to the coupling members. This makes it possible to mount an interlock, for two electromagnetic switching devices located side by side, in place of or in addition to auxiliary switch units.

8 Claims, 2 Drawing Sheets

INTERLOCK FOR ELECTROMAGNETIC SWITCHING DEVICES

BACKGROUND OF THE INVENTION

The present invention relates generally to interlocks, and more specifically to an interlock for mechanically locking out one of two electromagnetic switching devices, located side by side, while the other switching device is in its closed (on) position, and where the moving parts of the switching devices can be coupled to locking elements which extend from the interlock.

In an interlock of this type disclosed in German published patent application 32 13 477, the interlock is provided with a heart-shaped, shaftless rocker in a housing. Here the locking elements are in the form of pinlike parts which extend perpendicularly to the plane of motion of the rocker and are diametrically opposed in the direction of the respective switching devices with which they are to be linked. These pinlike parts are guided in an arcuate manner in slots in the housing that are adapted to the anticipated rocker motions. The ends of the pinlike parts which project from the housing are introduced through the side walls of the switching devices into grooves in driving members. The housing of the interlock here is joined to and mounted on the switching devices by means of catch hooks which snap into appropriately shaped apertures in the switching devices.

However, this type of an interlock requires that the electromagnetic switching devices be specifically adapted to allow them to be coupled to this type of interlock. This requirement does not allow the different kinds of interlocks or switching devices to be easily replaced if desired.

The present invention is directed to the problem of developing an interlock of the aforesaid type that can be coupled to electromagnetic switching devices without the latter being required to incorporate specific constructional features for this purpose.

SUMMARY OF THE INVENTION

The present invention solves this problem by having the moving parts of the switching devices also serve as the coupling members for auxiliary switches that can be set onto the switching device, and by conforming the locking elements to these coupling members.

An advantageous design for the coupling members occurs when they have the shape of a hammerhead and when the locking elements are designed as slide bars whose free ends terminate and clasp the hammerhead.

Having the other ends of the slide bars in interlocking engagement with an interlock rocker whose tip abuts in the lockout mode on an interlock contour in the housing of the interlock permits the present invention to use the known interlock rocker in an advantageous, simple manner.

Having the housing of the interlock incorporate a provision for accommodating the integral mounting means of the auxiliary switches permits the present invention to advantageously couple the housing of the interlock in a simple manner to the housings of the switching devices without having to resort to additional measures. Further, the present invention advantageously mounts the locking elements in the grid of the coupling members thereby allowing some extra space. If space for an additional coupling member is provided between two locking elements, for a four-pole contactor, for example, onto which four individual auxiliary-switch units can be snapped, allocating two positions to individual auxiliary switches with the interlock on one side and just one position on the other side, so that two auxiliary-switch positions are available on one contactor and three on the other, or vice versa is possible. If three auxiliary-switch positions are to be provided on both contactors, the two electromagnetic switching devices need only be mounted on the standard mounting rail separated by the grid spacing. Therefore, employing the interlock with larger types of electromagnetic switching devices when the first auxiliary-switch unit is spaced farther from the edge of the switching devices than it is with smaller contactors is possible.

To prevent the interlock from becoming detached from the switching devices onto which it has been set, adapting the interlock to be slipped onto and coupled to the switching devices at right angles to the direction of motion of their moving parts, and providing at least one slide bar for the releasable latching of the interlock to the switching devices is advantageous. Here a common slide bar for coupling the interlock to stationary parts of the switching devices may advantageously be provided.

DETAILED DESCRIPTION

Figure 2:
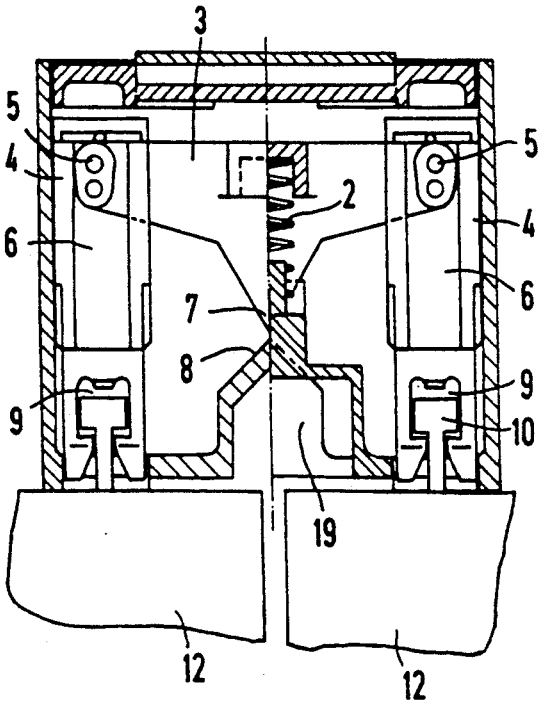
FIG. 2 is a partly sectional front elevation of the inventive interlock.
Figure 1:
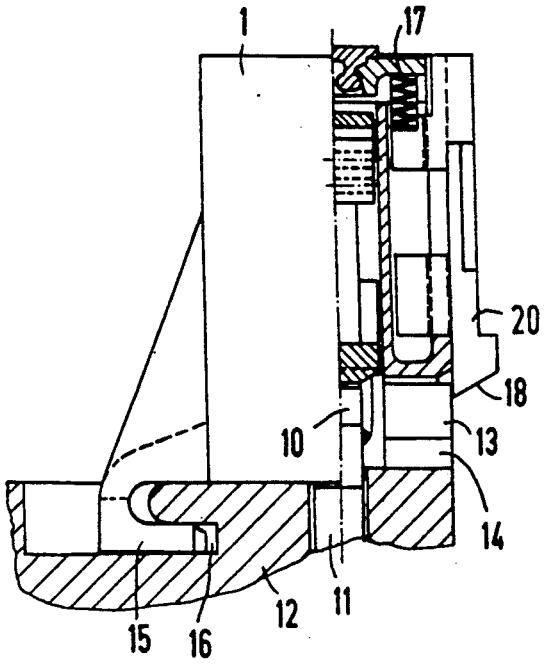
FIG. 1 is a partly sectional side elevation of an interlock coupled to a switching device.

The interlock of the present invention includes a housing 1 enclosing a rocker 3. The rocker 3 is biased by a spring 2, counter to the direction of closing motion of locking elements 4. The locking elements 4 are in more or less interlocking engagement through pins 5 that are integral with the rocker 3 and project into apertures 6 in the locking elements 4. The latter are guided in the housing 1 as locking slide bars. The rocker is of triangular form, and during the downward movement of one of the locking slide bars, the tip 7 of the triangle slides past appropriately shaped surfaces 8 of the housing 1, slightly spaced from them, so that the downward movement of the other locking slide bar 4 is prevented. That device is unable to switch on. The locking slide bars 4 are further provided with rectangular openings 9 open toward the free side so that a hammerhead 10, integral with the contact-crossbar bracket 11 of an electromagnetic switching device 12, can be pushed into the openings 9 to substantially interlock with it. Such coupling arrangements are known from German design patent 88 05 878, for example. A protuberance 13 in the shape of a hammerhead on the housing of the electromagnetic switching device 12 conforms to the hammerhead 10 and cooperates with appropriate projections 14 on the housing 1 of the interlock. Two hooklike projections 15 on the housing 1 of the interlock engage an appropriately shaped recess 16 when the interlock is shifted into the service position so that the housing 1 is firmly united at three points with the housing of the electromagnetic switching device 12. To prevent the interlock from sliding back, a slide bar 20 is provided as a releasable latch. The slide bar 20 can be displaced against the force of a spring 17 or of resilient plastic tongues to release the hammerhead-shaped protuberance 13. As the interlock is being mounted, an inclined surface 18 urges the slide bar 20 back against the force of the spring until it latches behind the hammerhead-shaped protuberance 13. A recess 19 provided in the housing 1 midway between the two locking elements 4, which in this embodiment are configured as slide bars, is disposed in a grid spacing that allows for the individual auxiliary-switch positions, as illustrated in FIGS. 3 to 6. Therefore, setting the interlock onto two electromagnetic switching devices 12 in the optional arrangements as shown in FIGS. 3 to 6 is possible.

Figure 3:
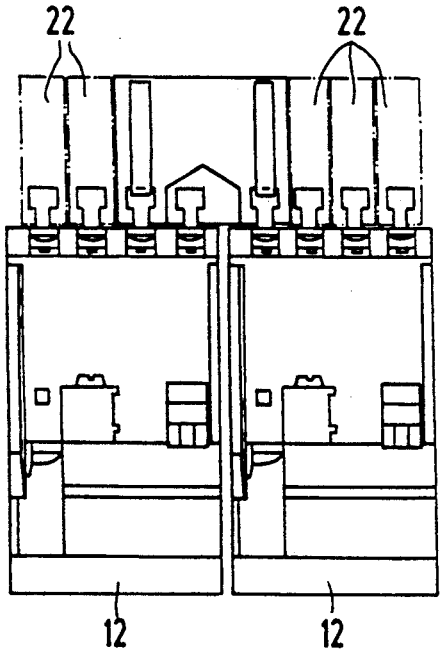
FIG. 3 is a front elevation of the interlock, set onto two electromagnetic switching devices, there being space available for two individual auxiliary-switch units on the left-hand switching device, and for three auxiliary-switch units on the right-hand switching device.
Figure 4:
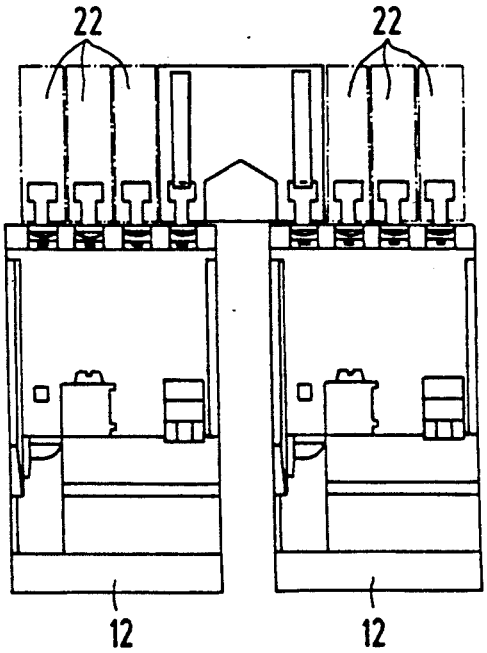
FIG. 4 shows the electromagnetic switching devices of FIG. 3 spaced apart, thus providing three auxiliary-switch positions on both electromagnetic switches.
Figure 5:
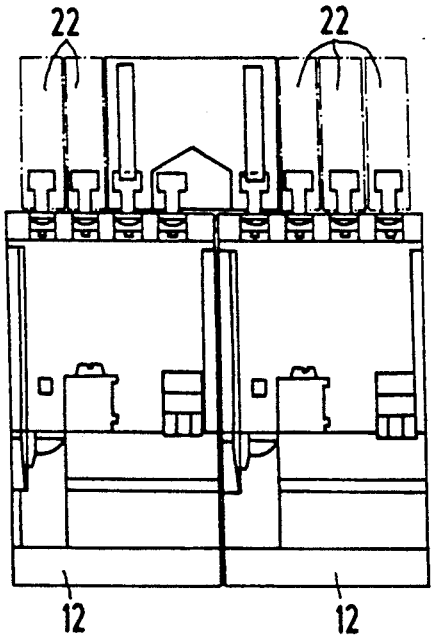
FIG. 5 shows an embodiment in which electromagnetic switching units of a different size are placed close together to permit the interlock to be set on them, whereas in the embodiment of FIG. 3 the switching devices are spaced slightly apart.
Figure 6:
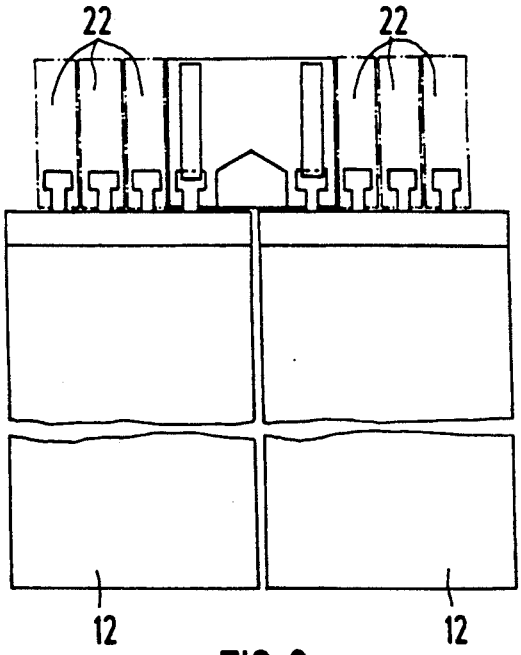
FIG. 6 illustrates an optional method of mounting the interlock on two electromagnetic switching devices of a still larger size. Here three auxiliary-switch positions are provided in every case on each switching device. Adapting the electromagnetic switching devices to the grid spacing required for the interlock will pose no problem since the electromagnetic switching devices can readily be shifted sideways on a standard mounting rail.

In FIG. 3, two auxiliary-switch units 22 can be set onto the left-hand contactor, in addition to the interlock, and three auxiliary-switch units 22 on the right-hand contactor, the two electromagnetic switching devices 12 being spaced just slightly apart. However, if setting three auxiliary-switch units 22 onto both contactors is desired, the two electromagnetic switching devices 12 may by mounted on the standard mounting rail at some distance from each other, as shown in FIG. 4. The same principle applies when electromagnetic switching devices of a somewhat larger size are involved, as shown in FIG. 5. There, the two switching devices 12 are not spaced apart at all in contrast with the arrangement of FIG. 3. In the embodiment shown in FIG. 6, the interlock is applicable to contactors 12 of a larger size. Here the individual auxiliary switch units are mounted farther from the edge of the switching devices so that here three auxiliary switch units 22 can always be set onto both electromagnetic switching devices. The unipolar auxiliary-switch units and the manner of the setting are known from DE-GM 8808 878, which corresponds to U.S. Pat. No. 4,956,624.

What is claimed is:

1. A device comprising:

a) a first switching device, said first switching device
   i) having a first moving part;

b) a second switching device, said second switching device
   i) having a second moving part, and
   ii) being arranged side by side with said first switching device; and c) means for mechanically locking out said first switching device when said second switching device is in a closed position, said means for mechanically locking out including
   i) a first locking element, said first locking element having a first coupling part, said coupling part of said first locking element being adapted to couple with said moving part of said first switching device, and
   ii) a second locking element, said second locking element having a second coupling part, said coupling part of said second locking element being adapted to couple with said moving part of said second switching device,.

wherein said first and second moving parts of said first and second switching devices are capable of further serving as coupling members for auxiliary switches that may be set onto the first and second switching devices, respectively.

2. The device as claimed in claim 1 wherein said first and second switching devices are electro-mechanical switches.

3. The interlock according to claim 2, wherein said plurality of coupling members are shaped like a hammerhead, and the plurality of locking elements are a plurality of slide bars that have a plurality of free ends which terminate clasping the hammerhead.

4. An interlock according to claim 3, further comprising:

a) a housing having an interlock contour;

b) an interlock rocker having a tip, wherein said plurality of slide bars further comprises a plurality of other ends that are in interlocking engagement with said interlock rocker whose tip abuts in a lockout mode on said interlock contour in the housing.

5. An interlock according to claim 4, wherein said housing further comprises a provision for accommodating an integral mounting means of the auxiliary switches.

6. An interlock according to claim 2, wherein said plurality of coupling members have a grid, and said plurality of locking elements are mounted in the grid of the coupling members allowing some extra space.

7. An interlock according to claim 6, wherein said plurality of locking elements have space between two locking elements for another coupling member.

8. An interlock according to claim 7, wherein said interlock is adapted to be slipped onto and coupled to the electromagnetic switching devices at right angles to a direction of motion of the plurality of moving parts, and further comprising at least one slide bar for a releasable latching of the interlock to the switching devices.

* * * * *